United States Patent [19]

Fuquay

[11] Patent Number: 4,880,165

[45] Date of Patent: Nov. 14, 1989

[54] HAND-HELD SPRAY DEVICE

[76] Inventor: Kevin Fuquay, 11381 Asbury Park, Detroit, Mich. 48227

[21] Appl. No.: 167,588

[22] Filed: Mar. 14, 1988

[51] Int. Cl.[4] ..... B05B 9/00

[52] U.S. Cl. ..... 239/525

[58] Field of Search ..... 239/525, 526, 530, 588, 239/529, 532; 16/126, 127, 110 R, 111 R, 125; D7/319; 222/323, 465 R

[56] References Cited

U.S. PATENT DOCUMENTS

| | | | |
|---|---|---|---|
| 197,865 | 12/1877 | Knapp | 16/125 |
| 2,132,459 | 10/1938 | Cockcroft | 239/529 |
| 2,271,843 | 2/1942 | Newman et al. | 239/525 |
| 2,289,889 | 7/1942 | Stick et al. | 239/530 X |
| 2,724,615 | 11/1955 | Ariotti . | |
| 3,076,608 | 2/1963 | Valles . | |
| 3,112,884 | 12/1963 | Gilmour . | |
| 3,380,705 | 4/1968 | Enssle . | |
| 3,515,355 | 6/1970 | Wagner . | |
| 3,701,478 | 10/1972 | Tada | 239/333 |
| 4,621,770 | 11/1986 | Sayen | 239/304 |
| 4,651,929 | 5/1987 | Kränzle | 239/288 |
| 4,666,085 | 5/1987 | Liaw . | |
| 4,674,687 | 6/1987 | Smith | 239/447 |

FOREIGN PATENT DOCUMENTS

| | | | |
|---|---|---|---|
| 1006264 | 4/1957 | Fed. Rep. of Germany | 239/525 |
| 769885 | 3/1957 | United Kingdom | 239/525 |

*Primary Examiner*—Andres Kashnikow
*Assistant Examiner*—Kevin P. Weldon
*Attorney, Agent, or Firm*—Brooks & Kushman

[57] ABSTRACT

In combination with a hand-held spray device (10) for use by an operator in a beauty salon, barber shop, or the like, the device including a hose (14), a housing (18) connected to the hose (14), and an outlet (20) through which the water is dispersed, an improvement which includes a loop (22) mounted upon the device (10) through which a finger (12) of the operator's hand (28) is inserted. Also provided is a connection (30) which secures the loop (22) to the device (10) whereby the operator controls positioning and orientation of the device (10) by inserting the finger (12) through the loop (22) and grasping the device (10) to control the direction of effluent water flow, even when the device (10) is wet and slippery and is subjected to surge forces associated with varying water pressure.

1 Claim, 2 Drawing Sheets

HAND-HELD SPRAY DEVICE

TECHNICAL FIELD

This invention relates to a hand-held spray device for use by an operator in a beauty salon, barber shop, or the like.

BACKGROUND ART

Hand-held spray devices are commonplace in the beauty salon and barber shop professions. Water spray guns are also used for horticulture or gardening, and can also be applied for car washing or ground cleaning.

Particularly in the beauty salon and barber shop business, however, the need arises to grasp the device securely by hand while the device is covered with slippery liquids such as shampoos and conditioners while the spray is subjected to surge forces associated with varying water pressures.

Conventional spray guns include those disclosed in U.S. Pat. Nos. 4,666,085; 4,651,929; and 4,621,770. Each device disclosed in these references, however, is relatively cumbersome to use because it includes a device for shutting off the flow of water. Thus, each device disclosed in such references is relatively bulky and awkward to manipulate, since it requires a secure grip, squeezing, and release action in order to operate for its intended purpose.

It is an object of the present invention to provide an economical improvement to conventional hand-held spray devices whereby an operator can control positioning and orientation of the device.

Accordingly, it is the primary aim of the invention to teach an improvement which allows the operator easily to pick up and put down the spray device using only a finger action without the need to grasp the entire device by all fingers of the operator's hand.

It is, therefore, an object of the present invention to provide an improvement whereby an operator can control the direction and flow of effluent water from the device when the device is covered by slippery liquids, such as shampoos and detergents.

Also, a related object is to provide an improvement which enables the positioning and orientation of the device to be controlled even while the device is subjected to surge forces associated with varying water pressures.

Moreover, a collateral objective is to teach an improvement which can be readily adapted by either a left- or a right-handed operator.

A correlated object is to offer an improvement which enables more control of the device to prevent unwanted spraying of the operator and others.

Finally, an allied object is to provide a device which can be used in a variety of places, such as beauty salons, restaurants, laundry rooms, kitchens, and the like.

DISCLOSURE OF THE INVENTION

In carrying out the above objects, the improvement in the hand-held spray device of the invention comprehends use of a hand-held spray device by an operator in a beauty salon, barber shop, or the like. The hand-held spray device directs the flow of effluent water under pressure, and includes a hose having an inlet through which the water flows into the device, a housing connected to the hose, and an outlet associated with the housing through which the water is disbursed.

In combination with such a hand-held spray device, an improvement is disclosed which comprises a loop located proximate the housing and defining an opening through which a finger of the operator's hand is inserted. A connection secures the loop to the device whereby the operator controls positioning and orientation of the outlet by inserting the finger through the loop and grasping the device to control the direction of effluent water flow from the outlet, even when the device is wet and slippery and is subjected to surge forces associated with varying water pressure.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
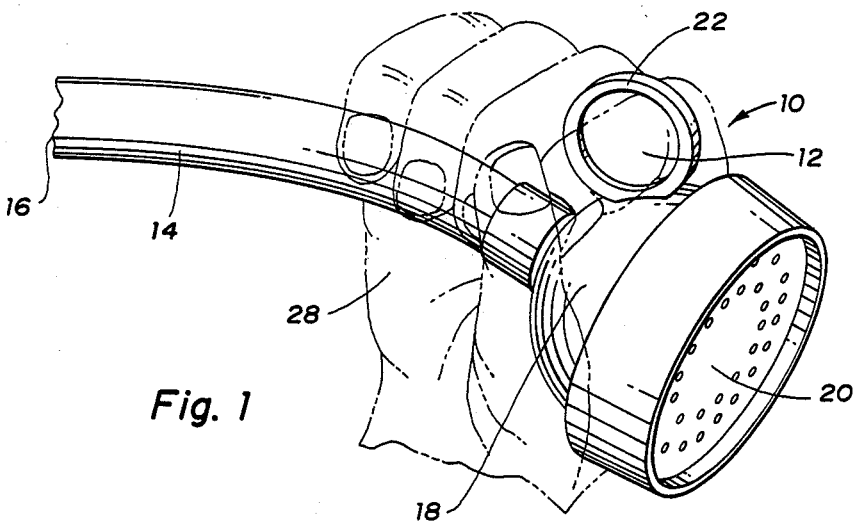
FIG. 1 is a perspective view of a hand-held spray device constructed in accordance with the present invention.

With reference to the drawings, there is shown in FIG. 1 a hand-held spray device 10 for use by an operator in a beauty salon, barber shop, or the like. The device 10 directs the flow of effluent water under pressure. Included in the device 10 is a hose 14 which has an inlet 16 through which the water flows into the device 10. Downstream from the hose 14 is a housing 18 which is depicted in a generally hemi-spherical form, although other forms may also be used, such as frusto-conical shapes and the like. An outlet 20 is associated with the housing 18 through which the water is sprayed.

In combination with the device 10, a loop 22 is disclosed which is located proximate the housing 18. The loop 22 defines an opening 24 through which a finger 12 of the operator's hand 28 is inserted.

A connection 30, such as a weld, cement, glue, or the like secures the loop 22 to the device 10. Thus, the operator controls positioning and orientation of the outlet 20 by inserting the finger 12 through the loop 22 and grasping the device 10 to control the direction of effluent water flow from the outlet 20, even when the device 10 is wet and slippery and is subjected to surge forces associated with varying water pressure.

Figure 2:
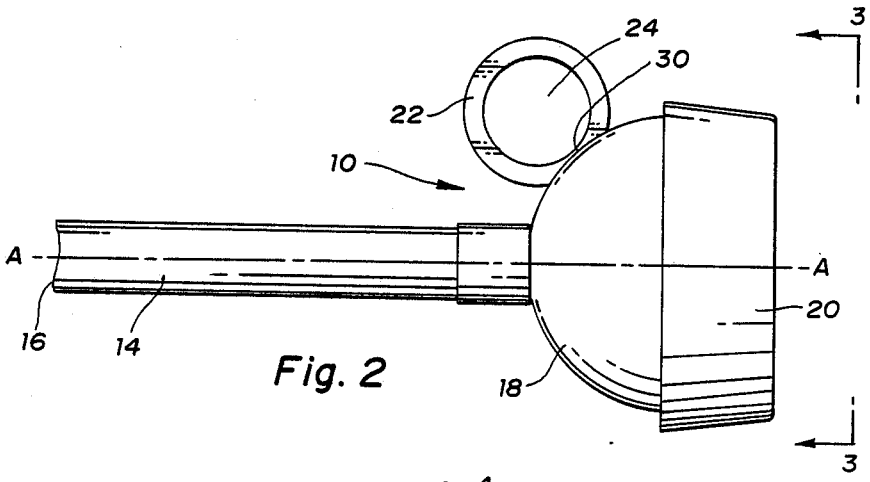
FIG. 2 is a perspective side view of the hand-held spray device of the present invention.
Figure 3:
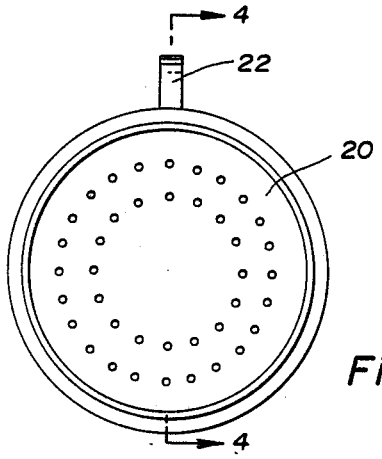
FIG. 3 is a front view of the hand-held spray device of the present invention taken from the direction 3—3 of FIG. 2.
Figure 4:
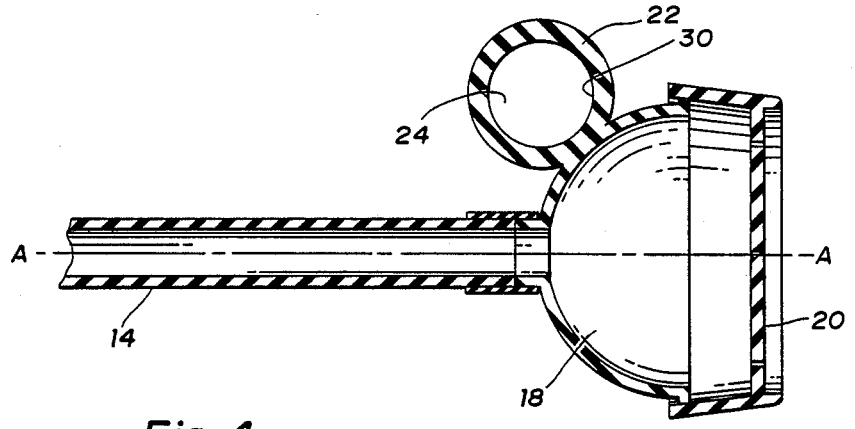
FIG. 4 is a sectional view of the handheld spray device of the present invention taken along the line 4—4 of FIG. 3.

Turning now to FIGS. 2–4, there is shown a first embodiment of the invention. In this embodiment, the loop 22 is connected to the housing 18 proximate the outlet 20 for retention by the operator's hand 28.

Figure 5:
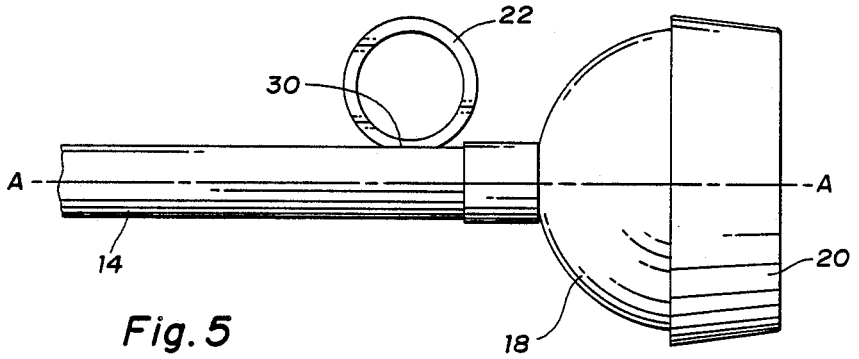
FIG. 5 is a side view of an alternate embodiment of the hand-held spray device of the present invention.

Turning next to FIG. 5, an alternate or second embodiment of the present invention is disclosed. In this embodiment, the loop 22 is connected to the hose 14 upstream from the housing 18 for retention by the operator's hand 28.

Continuing with reference to FIGS. 2 and 4–6, the hose 14 includes a longitudinal axis A—A. In FIGS. 2–5, the loop 22 projects from the device 10 in a generally radial direction relative to the longitudinal axis A—A of the hose 14.

Figure 6:
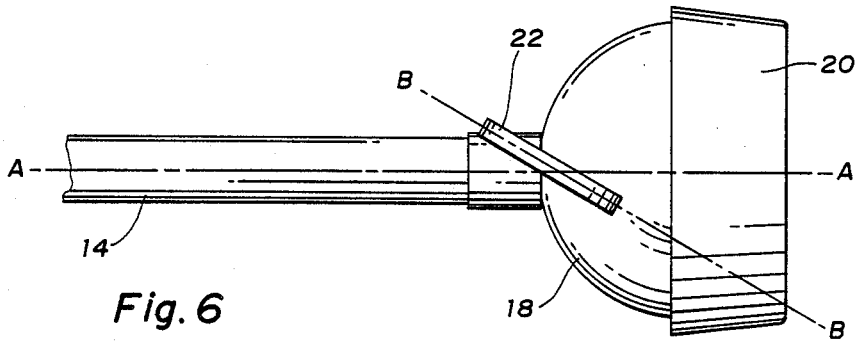
FIG. 6 is a top view of a third embodiment of the hand-held spray device in accordance with the present invention.

Turning now to FIG. 6, a third embodiment of the present invention is disclosed. As in the embodiments discussed earlier, the loop 22 is planar. In this embodiment of the invention, however, the plane B—B of the loop 22 is inclined to the longitudinal axis A—A of the hose 14 to facilitate engagement and retention of the loop 22 by a finger 12 of the operator's hand 28.

As is readily seen, the inclined feature of the third embodiment can also be used in combination with the second embodiment disclosed in FIG. 5. Thus, with particular reference to FIG. 5, the loop 22 which generally extends radially from the longitudinal axis A—A of the hose 14 and may be canted, or inclined. Under this arrangement, the loop 22 facilitates engagement of the loop 22 and the hose 14 by the operator's hand 28 and finger 12.

In keeping with the invention, the connection 30 may be adjusted so as to alter the angular relationship between the A—A and B—B axes. This unique feature of Applicant's invention as claimed can readily be appreciated by primary reference to FIG. 6. It has been found in practice that superior results can be obtained by fabricating the connection 30 from semi-rigid plastic. In this way, the orientation of the loop 22 can be customized according to the operator's preference by adjusting the connection 30 so as to alter the inclination of the plane B—B of the loop 22 relative to the longitudinal axis A—A of the hose 14 in order to accommodate the operator's preference and whether he or she is right- or left-handed.

In the preferred construction, the connection 30 which secures the loop 22 to the device 10 can be formed by plastic injection molding, or by other similar techniques. In this way, the loop 22 can be made integral with the hose 14, or with the housing 18, or can be oriented so that it is conjunctive with both. Other forms of adjustable connection 30 are also possible, such as cement, glue, lashing, or the like.

Preferably, the loop 22 is made of a deformable, semi-rigid rubber or plastic material so as to ensure snug conformity of the loop 22 with the finger 12 of the operator's hand 28. It will readily be appreciated that while the size of the loop 22 depicted in the drawings may suggest adaptation by one finger only, other sizes and shape of loop are possible so that multiple fingers can be engaged through the loop at one time.

Thus, it is apparent that there has been provided in accordance with the invention a hand-held spray device that fully satisfies the objects, aims, and advantages set forth above. While the best mode for carrying out the invention has been described in detail, those familiar with the art to which this invention relates will recognize alternative ways of practicing the invention as defined by the following claims.

What is claimed is:

1. In combination with a hand-held spray device for use by an operator in an environment such as a beauty salon for directing the flow of effluent water under presure, the device including a hose having an inlet through which the water flows into the device, a housing connected to the hose and an outlet associated with the housing through which the water is dispersed, the improvement which comprises:

a loop located proximate the housing and defining an opening through which a finger of the operator's hand is inserted so that the positioning and orientation of the device can be controlled by digital pressure exerted on the device through the loop; and a connection which secures the loop to the device whereby the operator controls positioning and orientation of the outlet by inserting the finger through the loop and grasping the device by the hand to control the direction of effluent water flow from the outlet even when the device is wet and slippery and is subjected to surge forces associated with varying water pressure, wherein the connection is adjustable whereby the loop can be inclined over a relatively small range of angular displacement relative to the hose to facilitate secure engagement of the loop by either a left-handed or a right-handed operator.

* * * * *